US008746128B2

(12) United States Patent
Cannata

(10) Patent No.: US 8,746,128 B2
(45) Date of Patent: Jun. 10, 2014

(54) VARIABLE DISPLACEMENT PISTON-IN-PISTON HYDRAULIC UNIT

(75) Inventor: Antonio Cannata, London (CA)

(73) Assignee: Tonand Brakes Inc., London (CA)

( * ) Notice: Subject to any disclaimer, the term of this patent is extended or adjusted under 35 U.S.C. 154(b) by 740 days.

(21) Appl. No.: 13/037,700

(22) Filed: Mar. 1, 2011

(65) Prior Publication Data

US 2012/0222546 A1 Sep. 6, 2012

(51) Int. Cl.
*F15B 15/14* (2006.01)

(52) U.S. Cl.
USPC ..... 92/81; 92/107; 92/115; 92/129

(58) Field of Classification Search
CPC ..... F04B 49/12; F04B 49/14; F04B 39/0005; F15B 15/14; F15B 1/24; F02D 15/04; F16D 57/06
USPC ..... 92/12.1, 13, 13.7, 81, 107, 108, 113, 92/114, 115, 129; 417/471, 494
See application file for complete search history.

(56) References Cited

U.S. PATENT DOCUMENTS

| | | | | |
|---|---|---|---|---|
| 3,417,702 | A * | 12/1968 | Behm | 417/494 |
| 3,476,220 | A * | 11/1969 | Kobayashi | 92/107 |
| 4,203,501 | A * | 5/1980 | Cholet et al. | 181/120 |
| 4,343,226 | A * | 8/1982 | Ribeiro de Almeida | 92/108 |
| 4,412,603 | A * | 11/1983 | Bischoff | 188/106 P |
| 4,907,495 | A * | 3/1990 | Sugahara | 92/108 |
| 4,961,372 | A * | 10/1990 | Leonhartsberger | 92/108 |
| 5,009,068 | A * | 4/1991 | Clarke | 92/13.1 |
| 7,487,709 | B2 * | 2/2009 | Muller et al. | 92/114 |
| 7,828,395 | B2 | 11/2010 | Cannata | |

* cited by examiner

*Primary Examiner* — Thomas E Lazo
(74) *Attorney, Agent, or Firm* — Grant Tisdall; Gowling Lafleur Henderson LLP

(57) ABSTRACT

A piston-in-piston hydraulic unit is disclosed that utilises an elastic volume to store and release energy with each stroke by varying the hydraulic fluid volumes in and out of the hydraulic unit.

20 Claims, 12 Drawing Sheets

VARIABLE DISPLACEMENT PISTON-IN-PISTON HYDRAULIC UNIT

TECHNICAL FIELD

The present disclosure relates to the field of hydraulic piston operated devices.

BACKGROUND

Traditional braking such as drum or disc braking systems have been widely used in a range of vehicle applications. However, brake fade caused when the drums or discs and the linings of the brakes overheat from excessive use become particularly problematic in large vehicle applications. Traditional braking systems usually require regular maintenance to service and replace consumable components, such as brake pads. Large vehicles such as locomotives, semi-trailer trucks, waste collection vehicles, construction vehicles and other large multi-axle vehicles require considerable braking power to adequately control braking, particularly when the vehicle is carrying a load. Reliability of braking systems can have significant implications in terms of safety and cost.

As an alternative to traditional friction resistance brakes, liquid resistance or direct hydraulic braking have been used which do not rely on friction to transmit braking force. However, these systems have been limited in application due to sizes required to achieve the desired braking efficiency and modulation capability. The use of a hydraulic pump in direct hydraulic braking, having a reciprocating piston, can require significant fluid displacement to achieve desired brake horse power (BHP). However, the relatively large displacement required to achieve high braking can impact the design of piston units, for example requiring larger sized units due to larger bores and/or increased stroke lengths, thus limiting their application.

SUMMARY

There is a need for a compact piston unit that provides improved hydraulic performance.

In one embodiment, the piston unit comprises a main block having a primary piston bore located there-through and having an axis extending lengthwise through the primary piston bore. A primary piston comprising a secondary piston bore in a portion thereof, is operable to reciprocate within the primary piston bore along the axis. A secondary piston is configured to be received within the secondary piston bore, and operable to reciprocate therein along the axis of the channel, the secondary piston defines a gas cavity between a bottom surface of the secondary piston and the opposing and adjacent surfaces of the secondary piston bore. The primary piston and the secondary piston are operable to reciprocate along the axis relative to each other such that the primary piston is movable within the primary piston bore and the secondary piston is moveable within the secondary piston bore contrary to the movement of the primary piston. The piston unit also includes a head for encasing the primary piston and the secondary piston within the main block, thereby providing a fluid cavity positioned between a top surface of the secondary piston and the head.

According to another aspect of the present invention the secondary piston bore surrounds the secondary piston defining a piston-in-piston configuration.

According to another aspect of the present invention the secondary piston moves within the secondary piston bore relative to pressure of fluid injected into the fluid cavity.

According to another aspect of the present invention the secondary piston further comprises a gas passageway extending there-through. According to another aspect the secondary piston further comprises a stem extending there-from in communication with the gas passageway. According to another aspect the gas passageway comprises a gas check valve. According to another aspect the gas passageway is in direct fluid communication with the gas cavity.

According to another aspect of the present invention the head further comprises a gas inlet guide operable to fluidly couple to the secondary piston stem.

According to another aspect of the present invention the primary piston further comprises a recessed piston seal around the outer circumference thereof to contain fluid in the fluid cavity.

According to another aspect of the present invention the secondary piston is retained within the secondary piston bore using a snap ring recessed on an interior surface of the secondary piston bore.

According to another aspect of the present invention the secondary piston further comprises a recessed piston seal around an outer circumference thereof to contain fluid in the fluid cavity and gas in the gas cavity.

According to another aspect of the present invention the movement of the primary piston is relative to the movement of an external surface interfacing with a lower surface of the primary piston. According to another aspect the movement of the primary piston is relative to the movement of an axle, the piston moving in relation to a mechanical actuator coupled to the axle.

According to another aspect of the present invention the primary piston further comprises a piston bottom on a bottom surface thereof. According to another aspect the piston bottom comprises a ball joint recessed within the bottom portion of the piston bottom, the ball joint coupled to a plate providing a pivotable contact surface with respect to the primary piston.

In another embodiment, the piston unit comprises a main block having a secondary piston bore located there-through and having an axis extending lengthwise through the secondary piston bore. A secondary piston comprising a primary piston bore in a portion thereof, is operable to reciprocate within the secondary piston bore along the axis. A primary piston is configured to be received within the primary piston bore, and operable to reciprocate therein along the axis of the channel, the primary piston defining a gas cavity between a top surface of the primary piston and the opposing and adjacent surfaces of the primary piston bore. The primary piston and the secondary piston are operable to reciprocate along the axis relative to each other such that the primary piston is movable within the primary piston bore and the secondary piston is moveable within the secondary piston bore contrary to the movement of the primary piston. The piston unit also includes a head for encasing the primary piston and the secondary piston within the main block, thereby providing a fluid cavity positioned between a top surface of the secondary piston and the head.

In a further embodiment, the piston unit comprises a main block having a main bore located there-through and having an axis extending lengthwise through the main bore A piston sub-assembly is configured to be received within the main bore and operable to reciprocate therein along the axis of the main bore, the piston sub-assembly comprising a first piston comprising a piston bore in a portion thereof, and a second piston operable to reciprocate within the piston bore along the axis of the main bore. The first piston and second piston define a gas cavity therebetween and are operable to reciprocate along the axis relative to each other such that the first piston is movable within the piston bore contrary to the movement of the second piston. The piston unit also includes a head for encasing the piston sub-assembly within the main block, thereby providing a fluid cavity positioned between a top surface of the sub-assembly and the head.

In another embodiment, the head of the piston units described herein includes a fluid inlet and a fluid outlet for allowing fluid to enter and exit the fluid cavity. In another embodiment, the fluid inlet and fluid outlet each include a one way valve.

In another embodiment, at least one of the primary piston and the secondary piston are non-concentric about the axis.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1:
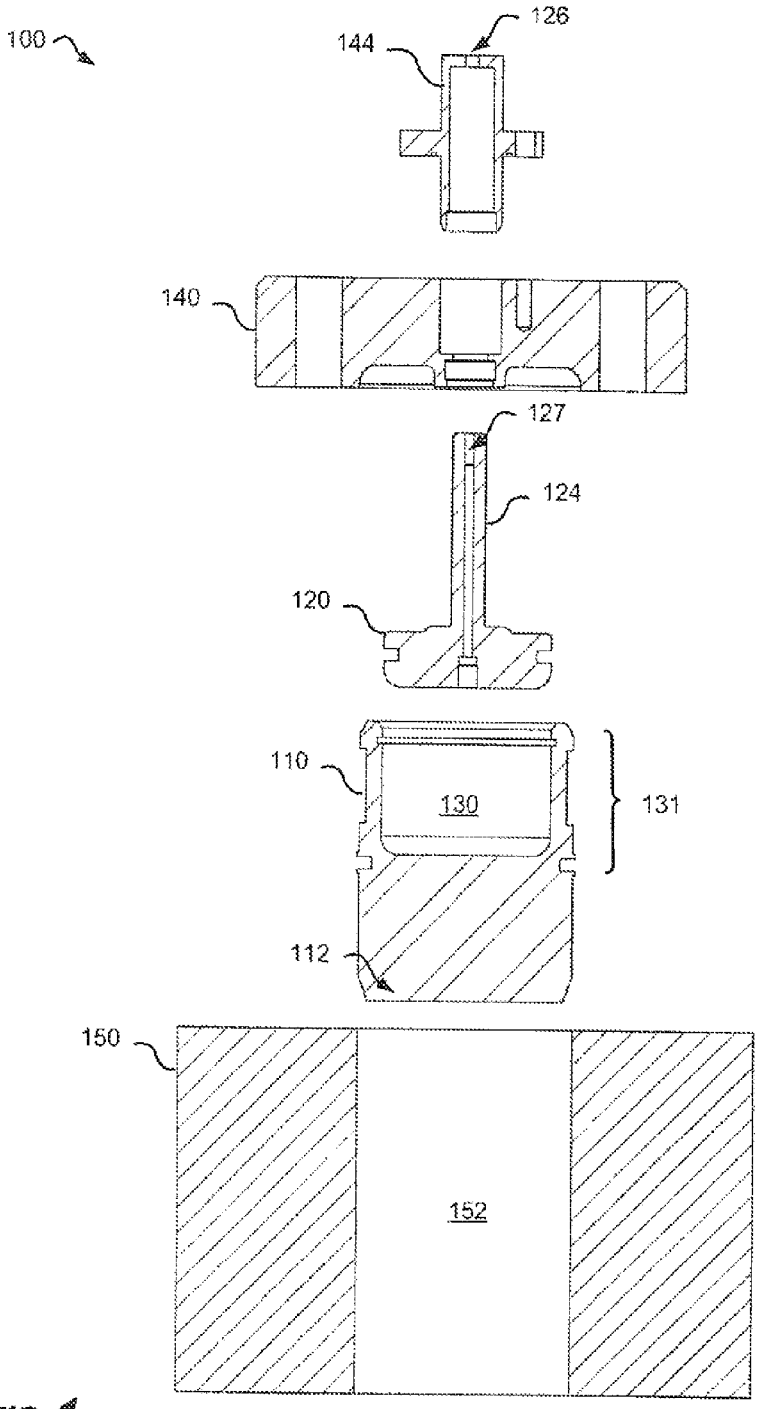
FIG. 1 shows an exploded view of one embodiment of a piston unit described herein.
Figure 2:
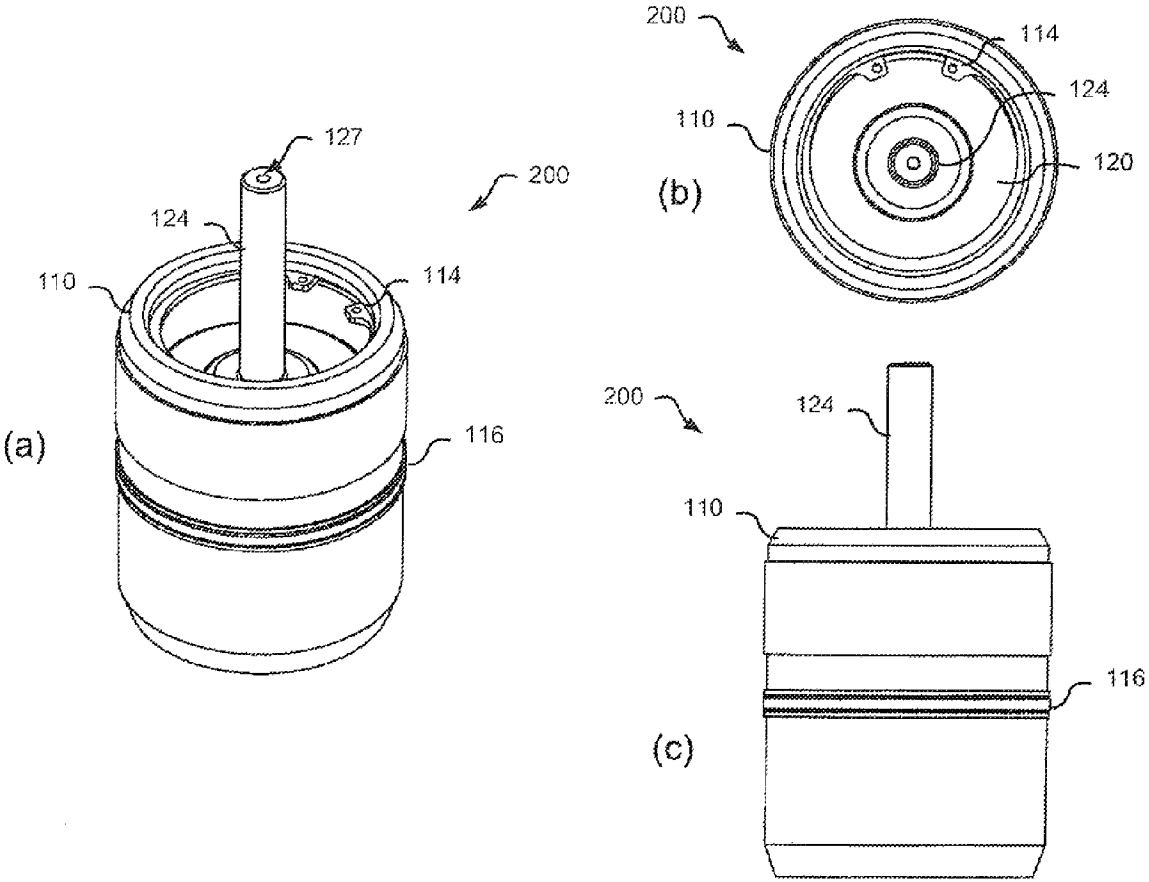
FIGS. 2A to 2C show different views of a secondary piston connected to a primary piston as described herein.
Figure 3:
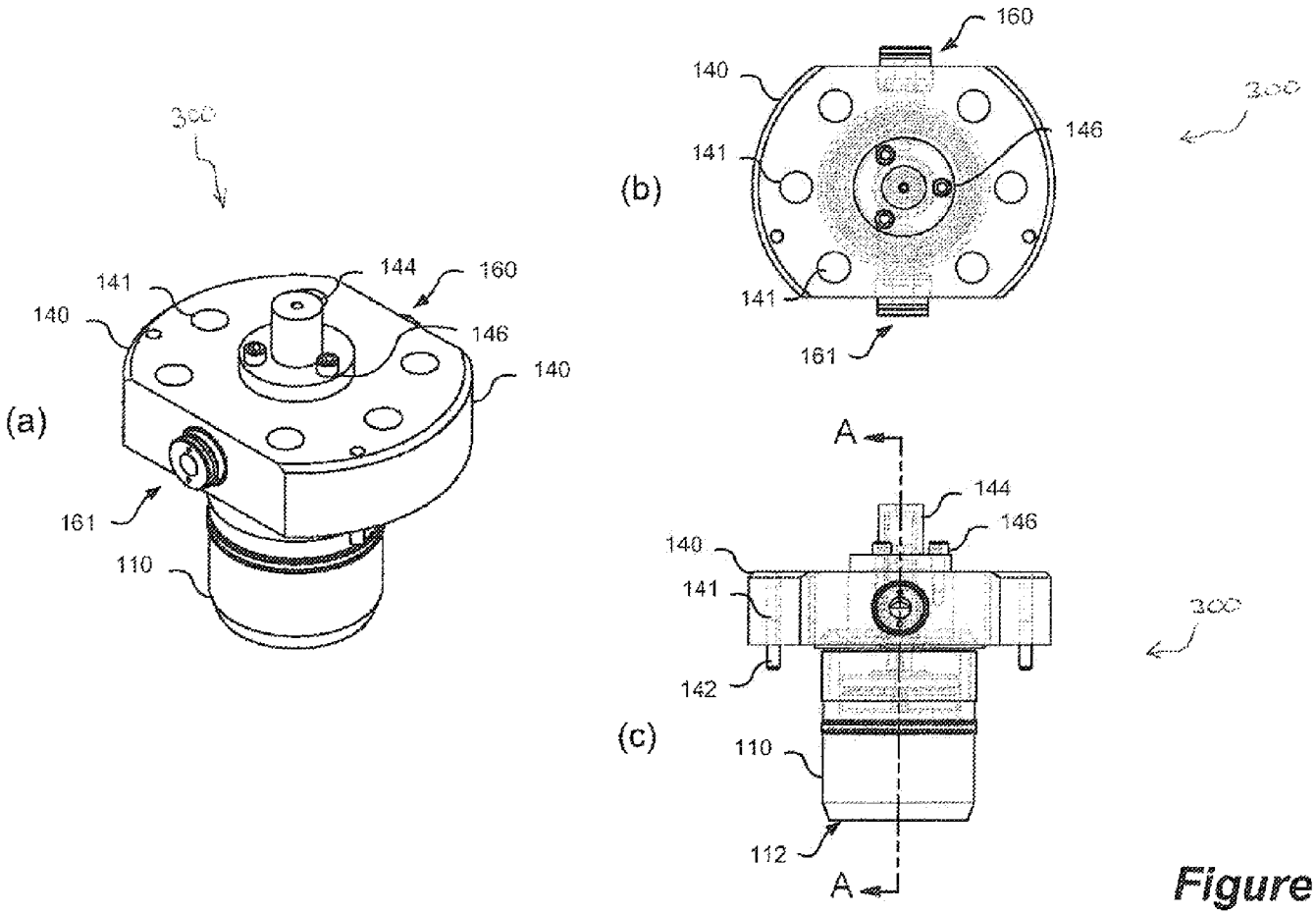
FIGS. 3A to 3C show different views of a head and piston sub-assembly, including the primary and secondary pistons of FIGS. 2A-C.
Figure 4:
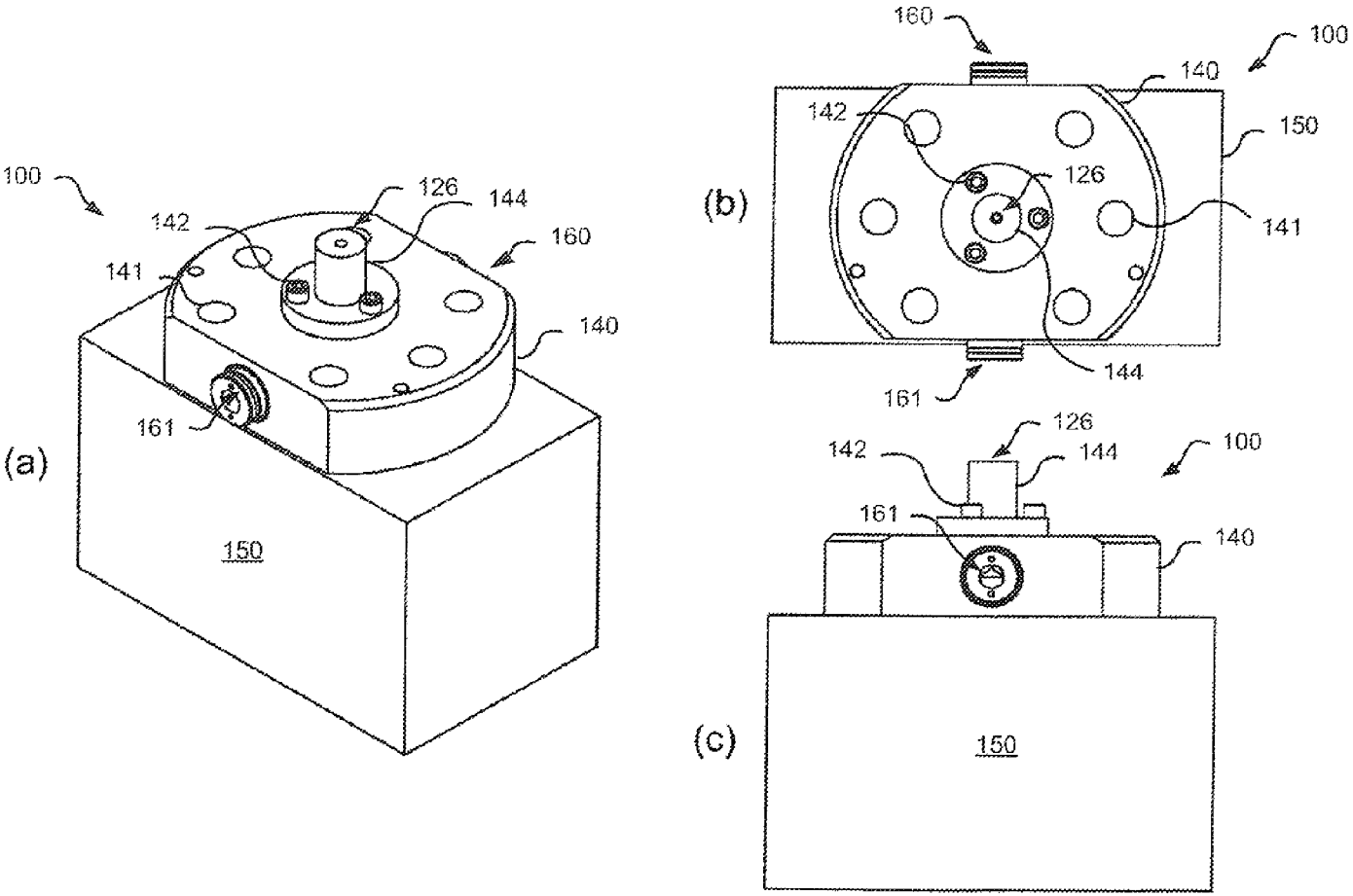
FIGS. 4A to 4C show different views of the piston unit of FIG. 1.

Embodiments are described below, by way of example only, with reference to FIGS. 1-9. The embodiments described and depicted herein provide a fluid and compressible piston-in-piston mechanism.

Described herein is a piston-in-piston unit that provides for the manipulation of hydraulic fluid used for braking applications, through the use of variable displacement techniques of the hydraulic fluid as further described below. The piston-in-piston hydraulic unit, described herein, and referred to as a piston unit 100, provides a greater range of operation that would not be possible using a traditional hydraulic unit. The interplay of a gas cavity (containing compressible gas) formed between a secondary piston and an alternating mechanical- and pressure-driven (e.g. mechanical on the way to Top Dead Center (TDC) and fluid driven on the way to Bottom Dead Center (BDC)) primary piston modulates the dynamics of the piston unit, which can facilitate an overall improvement in the performance of the piston unit by providing an elastic volume of the gas cavity that can store and release energy with each stroke by varying the hydraulic fluid volumes. It is also recognised that the volume of the gas cavity can remain relatively constant under certain operating conditions. The ability for the volume of the gas cavity to remain constant, or to change, facilitates an advantageous variable displacement operation of the piston unit, as further described below. It is recognised that power of the piston unit, described herein, is a function of the product of the flow of hydraulic fluid (i.e. volume per unit time) and the pressure differential between the input hydraulic fluid and the output hydraulic fluid.

In general, the piston unit comprises a primary piston and a secondary piston, the secondary piston actuating within a bore formed by or within the primary piston. One advantage of the piston unit is that the amount of hydraulic fluid that can be injected and/or ejected with respect to the piston unit can be varied dynamically, based on the injection pressure of the hydraulic fluid and/or the gas pressure inside of the gas cavity. This is facilitated by a secondary gas cavity that contains gas which is compressed or expanded (i.e. as influenced by the changing volume of the gas cavity), during piston unit operation, providing the variable displacement capability of the piston unit.

The primary piston of the piston unit can interface with a mechanical receiving member, such as a cam coupled to a drive shaft, to apply or deliver power, such as in a braking operation. It will be understood that the piston unit, described herein, is not limited to interaction with a cam and can couple with other receiving members known to a person skilled in the art, such as known crank shaft and connecting rod arrangements. However, for the purposes of the embodiments described herein, reference will be made to the receiving member being a cam. The piston unit can also be used in combination with multiple piston units to provide controlled deceleration.

Turning to the Figures, the piston unit 100, is described in further detail. FIG. 1 shows an exploded view of the main components of the piston unit 100. The piston unit 100 comprises a primary piston 110 positioned in a cylinder bore 152 and operable to reciprocate in the cylinder bore 152 along a longitudinal axis A (see FIG. 5), between top Dead Center (TDC) and Bottom Dead Center (BDC) further described below. The primary piston 110 has a secondary piston bore 130 in a top portion 131 thereof and is configured to receive the secondary piston 120 therein. Opposed and adjacent surfaces of the secondary piston 120 and the secondary piston bore 130 define a gas cavity 134 configured to contain a compressible gas. The secondary piston 120 includes a secondary piston stem 124, having a gas passageway 127 therethrough, which is described in further detail below, as an example mechanism for introducing, maintaining, and/or varying the volume of gas within the gas cavity 134.

The secondary piston 120 is operable to reciprocate within the secondary piston bore 130 relative to the primary piston 110, as facilitated by a pressure differential between the pressure of the hydraulic fluid in a fluid cavity 132 and the pressure of the gas in the gas cavity 134. It is noted that the secondary piston 120 is operable to move (e.g. reciprocate) within the secondary piston bore 130 independently of the position of the primary piston 110 in the bore 152. However, both pistons 110, 120 can also move simultaneously, as discussed below in the description of the operation of the piston unit 100.

Figure 5:
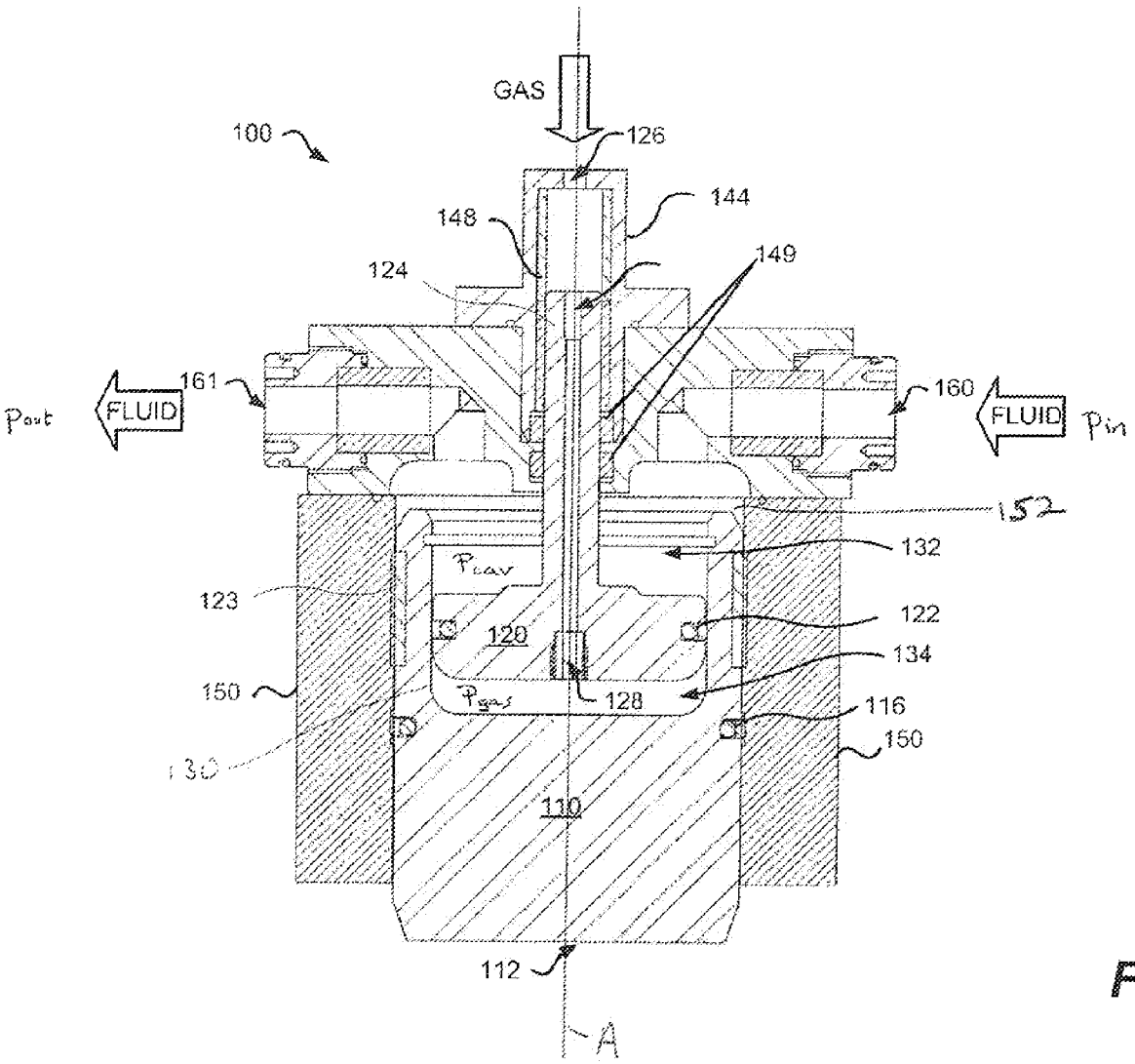
FIG. 5 shows a cross-sectional view of the assembled piston unit of FIG. 1.

The primary piston 110 is received within a main block 150, more specifically within the cylinder bore 152 in the main block 150. The cylinder bore 152 and the primary piston 110 are configured and sized to allow for reciprocal movement of the primary piston 110 within the cylinder bore 152. As can be seen in FIG. 5, the axis A runs lengthwise through the cylinder bore 152 and secondary piston bore 130, and movement of the secondary piston 120 and the primary piston 110 relative to each other, and relative to the cylinder bore 152, can be along this axis A. It is recognised that, shown by example, both the primary 110 and secondary 120 pistons are concentric about the axis A. However, it is recognised that the primary 110 and secondary 120 pistons can be non concentric about the axis A, as desired.

Located at the opposite end of the primary piston 110 from the top (e.g. adjacent to the snap ring 114) of the secondary piston bore 130 is a piston bottom 112. In use, the piston bottom 112 is operable to contact a cam or other mechanical actuation mechanism (not shown) that is coupled to an axle or drive shaft of a vehicle (not shown). The movement of the primary piston 110 within the cylinder bore 152 is driven by the movement of the cam through the contact between the piston bottom 112 and the cam. It is recognised that for simplicity, the cam is but one example of mechanical actuation as used herein.

FIGS. 2A to 2C show different views of a primary and secondary piston sub-assembly 200 that includes the primary piston 110 and the secondary piston 120. FIG. 2A shows a perspective view of the piston assembly 200, FIG. 2B a top view and FIG. 2C a side view. The secondary piston 120 is seated inside the secondary piston bore 130, and can be secured within the primary piston 110 by a snap ring 114. The secondary piston stem 124 extends above the top of the primary piston 110. The primary piston 110 has a piston seal 116 around the outer circumference, in a recess, not shown, within the outer surface of the primary piston 110. The piston seal 116 maintains a fluid seal around the piston assembly 200 when the piston assembly 200 is positioned within the cylinder bore 152 of the main block 150.

Although the secondary piston bore 130 and secondary piston 120 are shown to be cylindrical in shape each having a substantially flat base, as seen more clearly in FIG. 1, other shapes can be contemplated provided that the contour of the base of the secondary piston 120 is similar to the contour of the base of the secondary piston bore 130. Other configurations can therefore be utilized while operating in a similar manner as described herein.

As seen in FIG. 1, and FIGS. 3-5, a cylinder head 140 covers the secondary piston 120 and the primary piston 110 and is secured to the main block 150 encasing the pistons 110, 120 within the main block 150. When the primary piston 110 and the secondary piston 120 are encased in the main block 150 by the cylinder head 140, the fluid cavity 132 is defined by opposed and adjacent surfaces between the cylinder bore 152, the pistons 110, 120 and the cylinder head 140. The fluid cavity 132 defines a variable cavity volume for hydraulic fluid, which can vary depending upon the position of the pistons 110,120 along the axis A during operation of the piston unit 100.

The cylinder head 140 includes a fluid inlet 160 and a fluid outlet 161, which are in fluid communication with the fluid cavity 132. For example, the inlet 160 and the outlet 161 can contain fluid check valves for coordinating the injection and ejection of the hydraulic fluid from the fluid cavity 132, based on injection pressure $P_{in}$ of the hydraulic fluid, ejection pressure $P_{out}$ of the hydraulic fluid and cavity pressure $P_{cav}$ of the hydraulic fluid within the fluid cavity 132. Hydraulic fluid is therefore able to pass between the fluid inlet 160 and fluid outlet 161, through the fluid cavity 132, depending on inlet pressure $P_{in}$ of the hydraulic fluid and outlet pressure $P_{out}$ of hydraulic fluid as influenced by operation of the pistons 110, 120 (i.e. affecting cavity pressure $P_{cav}$ of the hydraulic fluid). It should be noted that the pressure of the hydraulic fluid in the fluid line adjacent to the outlet 161 is controlled by a pressure control valve (not shown). An example setting of the pressure control valve is 5000 psi.

A gas inlet guide cap 144, which includes a gas inlet 126, is coupled to the cylinder head 140 and covers the secondary piston stem 124. The gas inlet guide cap 144 covers the secondary piston stem 124 in such a way as to fluidly connect the gas inlet 126 with the gas passageway 127. The gas passageway 127 can be in line with the vertical axis of the secondary piston stem 124. Compressible gas, such as air, nitrogen or an inert mixture of gases, for example, are input through inlet 126 into gas passageway 127 of secondary piston 120 and subsequently into a gas cavity 134, described further below. It is recognised that the gas pressure $P_{gas}$ of the gas in the gas cavity 134 can be influenced by the injection and or ejection of a measured amount of gas, through the gas passageway 127, along with the relative position along axis A between the pistons 110, 120.

FIGS. 3A to 3C show different views of a head and piston sub-assembly 300. FIG. 3A shows a perspective view of the head and piston sub-assembly 300, including the gas inlet guide cap 144 and the cylinder head 140. FIG. 3B shows a top view of the head and piston sub-assembly 300 and FIG. 3C a side view. In the illustrated embodiment, the gas inlet guide cap 144 can be secured to the head 140 by fasteners, such as dowel pins 146, to facilitate an air tight seal. Other suitable fasteners, known to a person skilled in the art, can be used. The head 140 is provided with fastener holes 141, to be used in conjunction with appropriate fasteners, to mount the head and piston assembly 300 to the main cylinder block 150, shown in FIGS. 4A-C.

FIGS. 4A to 4C show views of an embodiment of an assembled piston unit 100. FIG. 4A shows a perspective view of the piston unit 100, FIG. 4B shows a top view of the piston unit 100 and FIG. 4C shows a side view of the piston unit 100.

The assembled piston unit 100 includes the main block 150, coupled to the cylinder head 140 with gas inlet guide cap 144 extending therefrom. Although the main block 150 is shown to be relatively rectangular in shape, the outer shape of the main block 150 can be tailored to fit any required application or can be manufactured as part of a larger block containing multiple head and piston assemblies 300 in varying configurations. As discussed further below, the piston bottom 112 of the primary piston 110 can be operable to extend below the lower end of the main block, also referred to as BDC shown in FIG. 5, so as to provide space for interaction of the primary piston 110 with mechanical actuation thereof.

The cylinder head 140 includes a hydraulic fluid inlet port 160 and a hydraulic fluid outlet port 161, which are in fluid communication with the fluid cavity 132. While the illustrated embodiment is described with reference to one inlet and outlet, it will be understood that multiple inlets/outlets can be provided in varying orientations.

FIG. 5 is a cross-sectional view of an assembled piston unit 100. The secondary piston 120 and the primary piston 110 are positioned within the cylinder bore 152 of the main block 150. The fluid cavity 132 is located between the upper surfaces of the primary 110 and secondary 120 pistons and the underside of the cylinder head 140 and adjacent surfaces of the cylinder bore 152. The gas cavity 134 is located between the bottom of the secondary piston 120 and the opposed internal lower surfaces of the secondary piston bore 130. Movement and associated position of the primary piston 110 and the secondary piston 120 within the cylinder bore 152 affects the size (i.e. volume) of the fluid cavity 132. Movement and associated position of the secondary piston 120 relative to the primary piston 110 will also affect the size (i.e. volume) of the gas cavity 134. This change in size, or volume, will be described further below in the description of the operation of the piston unit 100.

As stated above, the primary piston 110 is operable to move within the cylinder bore 152. Specifically, the primary piston 110 can move from one end to the other, within the cylinder bore 152, and is operable to extend out of the lower end of the cylinder bore 152. When the top of the primary piston 110 is located at the top of the cylinder bore 152 the position can be referred to as top dead center (TDC). When the piston bottom 112 of the primary piston 110 extends out of the bottom of the cylinder bore 152 it is referred to as bottom dead center (BDC). Both positions will be described in further detail below when discussing the example working embodiment of the piston unit 100.

It will be understood that the terms "top" and "bottom" referred to herein are used in the context of the attached Figures. The terms are not necessarily reflective of the orientation of the piston unit 100 in actual use and are therefore not meant to be limiting in their use herein.

The volumes of the fluid cavity 132 and the gas cavity 134 are defined by the relative position of the primary piston 110, during movement between BDC and TDC, the relative position of the secondary piston 120 within the primary piston 110 (i.e. within bore 130), and the injection pressures $P_{cav}$, $P_{gas}$ of the fluid and gas. In use, the injection pressure $P_{in}$ of the hydraulic fluid injected into the fluid cavity 132 can affect the pressure exerted on the gas cavity 134 by the pistons 110, 120. In use, the ejection pressure $P_{out}$ of the hydraulic fluid ejected out of the fluid cavity 132 can affect the pressure exerted on the gas cavity 134 by the pistons 110, 120 and the mechanical actuation (e.g. cam).

Gas is initially provided through gas inlet 126 to gas passageway 127 entering the gas cavity 134 through a check valve 128. The compressed gas in the gas cavity 134 facilitates the operation of the gas cavity 134 as an elastic volume which is able to store and release energy with each stroke of the primary piston 110. In other words, as the gas cavity 134 changes in volume due to the influence of mechanical actuation experienced by the primary piston 110 and the hydraulic fluid pressure $P_{cav}$ in the fluid cavity 132, variable displacement is performed by the piston unit 100 by varying injection pressure $P_{in}$, for example.

The secondary piston 120 includes a piston seal 122 to trap gas within the gas cavity 134 to inhibit bleed through into the hydraulic fluid cavity 132 above. The primary piston 110 can include one or more wear rings 123 to minimise wear of the external surface of the primary piston 110 as it moves within the cylinder bore 152, and/or to minimize potential wear of the inside wall/lining of the piston bore 152. The gas inlet guide cap 144 can be lined with secondary piston guide sleeves 148 to guide the stem 124 of the secondary piston 120 within the gas inlet guide cap 144. Secondary piston stem fluid seals 149 can also be provided to maintain a fluid tight seal around the stem 124 at the interface with the cylinder head 140.

Two examples of the operation of the piston unit 100 will now be described, In these examples, the $P_{in}$, $P_{out}$, $P_{cav}$, $P_{gas}$ are described as simple multiples of pressure P (e.g. P=100 psi), for demonstration purposes only. In both examples an assumption is made that the piston unit works into a head of 20P, i.e. fluid resistance in the hydraulic line (not shown coupled to the fluid outlet 161 is configured at 20P using a control valve (e.g. a fixed or variable sized orifice) located in the hydraulic line.

Turning now to FIGS. 6A to 6J the operation of the secondary piston 100 in a low pressure injection mode of operation will be described. In the configuration shown in FIGS. 6A to 6J the fluid injection pressure is low and resulting pump output is low. In this case $P_{in}$ can be set at or below $P_{gas}$.

As shown in FIG. 6A, the piston unit is in a "no-load state" or initial state where the primary piston 110 is at TDC and the secondary piston 120 is fully extended at the top of the secondary piston bore 130. The gas cavity 134 is provided with a gas volume, at a pre-determined pressure (e.g. $P_{gas}$=P) through the gas inlet stem 124. As primary piston 110 commences a down-stroke, in response to the interface between the piston bottom 112 and a cam (not shown) and inlet hydraulic fluid pressure, fluid is injected through fluid inlet port 160 at an injection pressure $P_{in}$=P. Fluid fills the cavity 132 as the primary piston 110 moves downwards within the cylinder bore 152. Further, the pressure $P_{cav}$ approximately equal to $P_{in}$ also moves the secondary piston 120 downwards in tandem with the primary piston 110. Since the fluid pressure in the fluid cavity 132 and gas pressure in the secondary gas cavity 134 can be configured to remain equal $P_{cav}$=$P_{gas}$ on both sides of the secondary piston 120, the secondary piston 120 does not move relative to the primary piston 110, as shown in FIGS. 6B and 6C in the down-stroke.

When the primary piston 110 reaches BDC, as shown in FIG. 6D, the secondary piston 120 is still at the top of the secondary piston bore 130 and the pressure $P_{cav}$, $P_{gas}$ is still substantially equal on both sides.

On commencement of the upstroke from BDC, as shown in FIG. 6E and FIG. 6F, the cam (or other mechanical actuation) drives the primary piston 110 upwards. The fluid cavity 132 is filled with fluid and the gas cavity 134 is fully expanded with the secondary piston 120 at the top of its stroke.

On commencement of the upstroke from BDC, the piston unit 100 is working into the head pressure of 20P, the pressures $P_{cav}$, $P_{gas}$ must reach this before any fluid volume is expelled from the piston unit 100. As the primary piston 110 rises, for example due to mechanical actuation via movement of the cam, the fluid pressure in the cavity 132 and the gas pressure in the cavity 134 increase, thereby moving the secondary piston 120 relative to the primary piston 110 and compressing the gas in the gas cavity 134 to an ever-diminishing volume that can completely "swallow" the entire injected volume of hydraulic fluid from the inlet 160. The primary and secondary pistons 110, 120 move upwards to TDC as shown in FIG. 6G. In this case, the $P_{cav}$ increases towards 20P, the secondary piston 120 is driven towards the primary piston 110 and therefore the volume of the gas cavity 134 decreases. This decrease in volume of the gas cavity 134 in turn drives $P_{gas}$ greater than P.

In this low pressure hydraulic fluid injection mode, the pressure $P_{cav}$ of the fluid volume in the cavity 132 is inhibited from reaching the required pressure 20P, as a result of the compensating reduction in the volume of the gas cavity 134. As a result, no fluid is expelled from the fluid cavity 132. In the case where no hydraulic fluid is ejected during the upstroke, the resulting pump delivery would be zero. It is recognised in general that only a relatively equal amount of hydraulic fluid that was ejected through the outlet 161 during the upstroke, if any, can be injected during the subsequent down stroke via the inlet 160.

During the ensuing downward stroke, shown in FIG. 6H to FIG. 6J, assuming the low injection pressure $P_{in}$=P does not change, no new hydraulic fluid enters fluid cavity 132 and the secondary piston 120 is not influenced to move downwards since $P_{cav}$ is equal to approximately $P_{in}$ (i.e. $P_{gas}$ is initially higher that P). In turn, the primary piston 110 moves downward since the force of the mechanical actuation against the piston bottom 112 is reduced (i.e. cam moves away), while the the compressed gas in the cavity 134 initially at $P_{gas}$ greater than P simply re-expands to "give back" the original volume in the gas cavity 134, as a consequence of the secondary piston 120 being subjected to hydraulic fluid $P_{in}$ at pressure P. In a low fluid injection mode, the gas volume behaves as a spring-loaded buffer that can "carry over" fluid from one stroke to the next while inhibiting vacuum in the fluid cavity 132 (i.e. hydraulic fluid is not injected into the fluid cavity on the down stroke but the secondary piston 120 remains near TDC as the primary piston 110 is travelling towards BDC due to the expanding gas cavity 134). In this manner, the volume of the gas cavity 134 alternates between a compressed/reduced state when subjected to a hydraulic fluid pressure outlet pressure $P_{out}$ upwards of 20P and an expanded state when subjected to a hydraulic fluid pressure $P_{in}$ of P.

It should be noted that the above description of the low pressure injection mode of operation is based on a simplified case of no pre-crush (i.e. decrease in the gas cavity 132 volume during initial injection of the hydraulic fluid via the inlet 160). This is because $P_{in}$ is at or below $P_{gas}$, which does not force via any positive pressure differential travel of the secondary piston 120 down into the secondary piston bore 130. However, in practical operation of the piston unit 100, there can be a number of practical resistances in flow of the injected hydraulic fluid that must be overcome, for example calibrated spring resistance of the check valve in the inlet 160, head loses in any fittings/hoses (not shown), and oil viscosity. Further, practical injection timing issues of measured volumes of hydraulic fluid in a timely fashion can provide for the need of higher injection pressures. One example of the practical considerations for higher injection pressures is to provide for a sufficient timely volume of hydraulic fluid in the cylinder bore 152 to encourage continual contact of the piston bottom 112 with the cam during travel of the primary piston 110 from TDC to BDC. For example, gas pressure $P_{gas}$ before any compression of the gas cavity 132 could be as low is 30 PSI. Initial oil injection pressure $P_{in}$ could be say, 100 PSI which is more than 30 psi for $P_{gas}$.

FIG. 7A to 7G show the operation of the piston unit 100 in a high pressure injection mode of operation. Initially a gas is fed to the gas cavity 134 at a predetermined pressure $P_{gas}$ of P and hydraulic fluid is fed through fluid inlet 160, at a pressure $P_{in}$ of 10P, for example. It should be noted that for this case, $P_{in}$ is substantially greater than $P_{gas}$, so as to effectively pre crush the gas cavity 134, through downward movement of the secondary piston 120, at the beginning of travel of the primary piston 110 towards BDC.

The primary piston 110 follows the cam downwards towards BDC, as hydraulic fluid enters the fluid cavity 132 at $P_{in}$ to influence the travel of the primary piston 110 towards BDC. It is recognised that the hydraulic fluid enters the fluid cavity 132 at a greater pressure than the pressure $P_{gas}$ of the gas in gas cavity 134, which causes displacement of the secondary piston 120 downwards into the bore 130 that decreases the volume of the gas cavity 134 in order to equalize the pressures $P_{cav}$ and $P_{gas}$. In other words, operation of the piston unit because of the set $P_{in}$ greater than $P_{gas}$ for the down stroke forces the primary piston 110 and secondary piston 120 to move relative to one another (i.e. towards one another in the case of down stroke) to reduce the volume size of the gas cavity 134. In this example, the secondary piston 120 is able to compress the gas cavity to 1/10 of its original volume, thereby allowing for more fluid to enter the fluid cavity 132 as the reduction in volume of the gas cavity 132 is added to the volume capacity of the fluid cavity 134, as the volumes of the cavities 132,134 are dependent upon one another for unequal pressures $P_{in}/P_{cav}$ and $P_{gas}$.

At BDC, shown in FIG. 7D, the fluid cavity 132 is filled with fluid and the secondary piston 120 continues to compress the gas within the gas cavity 134. At 10P of fluid injection pressure $P_{in}$, the gas cavity 134 can be approximately 90% collapsed. It is noted that only a very small amount of upstroke (when the active piston 110 begins travel from BDC towards TDC due to mechanical actuation) would be required to increase the pressure $P_{cav}$ towards and match the head pressure 20P in the outlet hydraulic line coupled to the fluid outlet 161.

As the primary piston 110 begins to move upwards, on the upstroke as shown in FIGS. 7E and 7F, the gas cavity 134 will continue to be compressed until the gas pressure $P_{cav}$ is equal to the pressure control valve setting (not shown) of the pressure in the hydraulic line (not shown) coupled to the outlet 161, for example into the head of 20P. When the two pressures $P_{gas}$ and $P_{cav}$ become equal, e.g. 20P, the hydraulic fluid in the fluid cavity 132 will be released via the fluid outlet 161 for further travel of the pistons 110,120 towards TDC. When TDC is reached, as shown in FIG. 7G, the volume of hydraulic fluid initially injected into the fluid cavity 132 would be approximately equal to the volume of hydraulic fluid ejected and the pump delivery would be near 100% capacity.

If during the ensuing down-stroke, hydraulic fluid is again injected at pressure 10P, the gas within gas cavity 134 would only re-expand slightly (e.g. from 1/20 to 1/10 of the uncompressed volume of the gas cavity 134) and the gas cavity 134 would therefore remain effectively compressed, thus inhibiting its "stroke swallowing" capacity. In high injection mode, the heavily compressed gas in gas cavity 134 virtually disappears as a buffer volume no longer able to "carry over" fluid from one stroke to the next, forcing a substantial volume of the fluid injected to be subsequently ejected from the fluid cavity 132.

Figure 6:
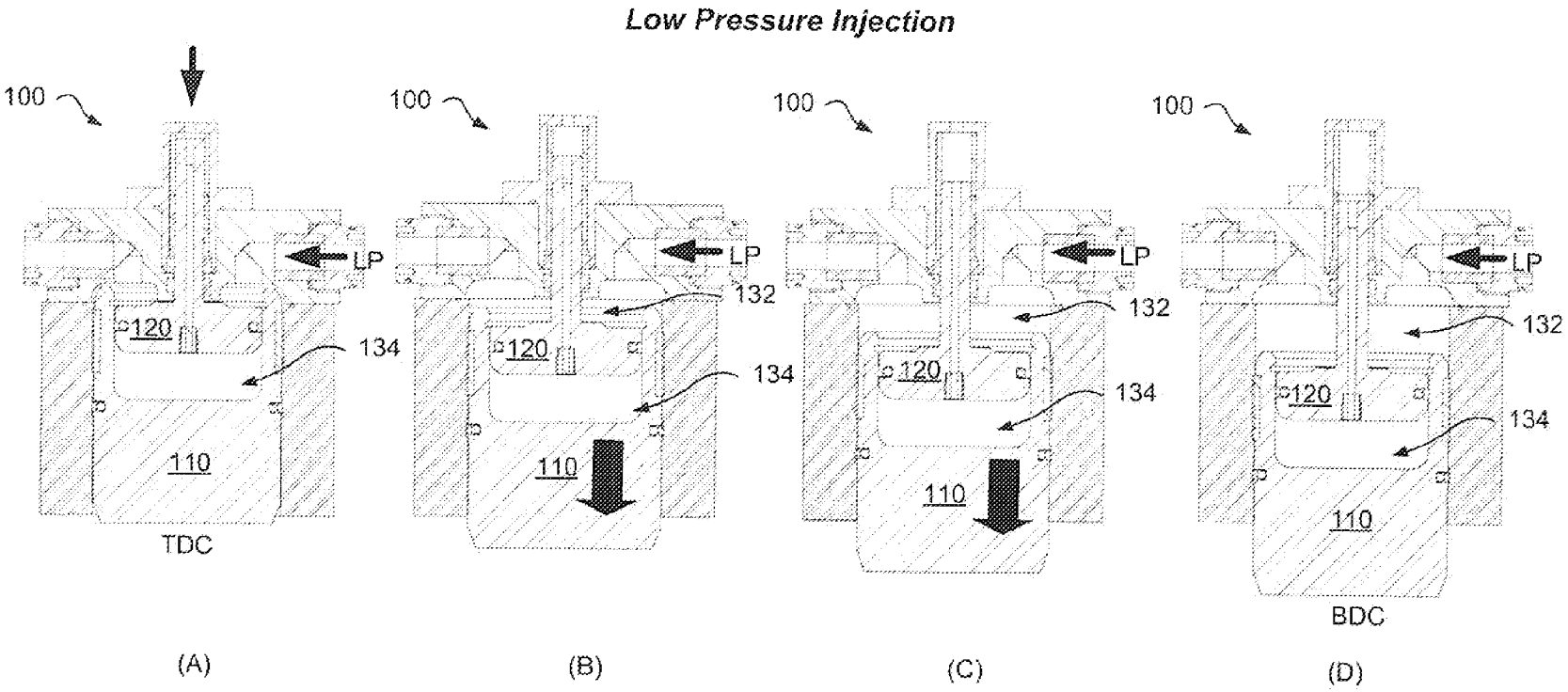
FIGS. 6A to 6J are schematics showing the operation of the piston unit in a low pressure injection mode of operation.
Figure 6:
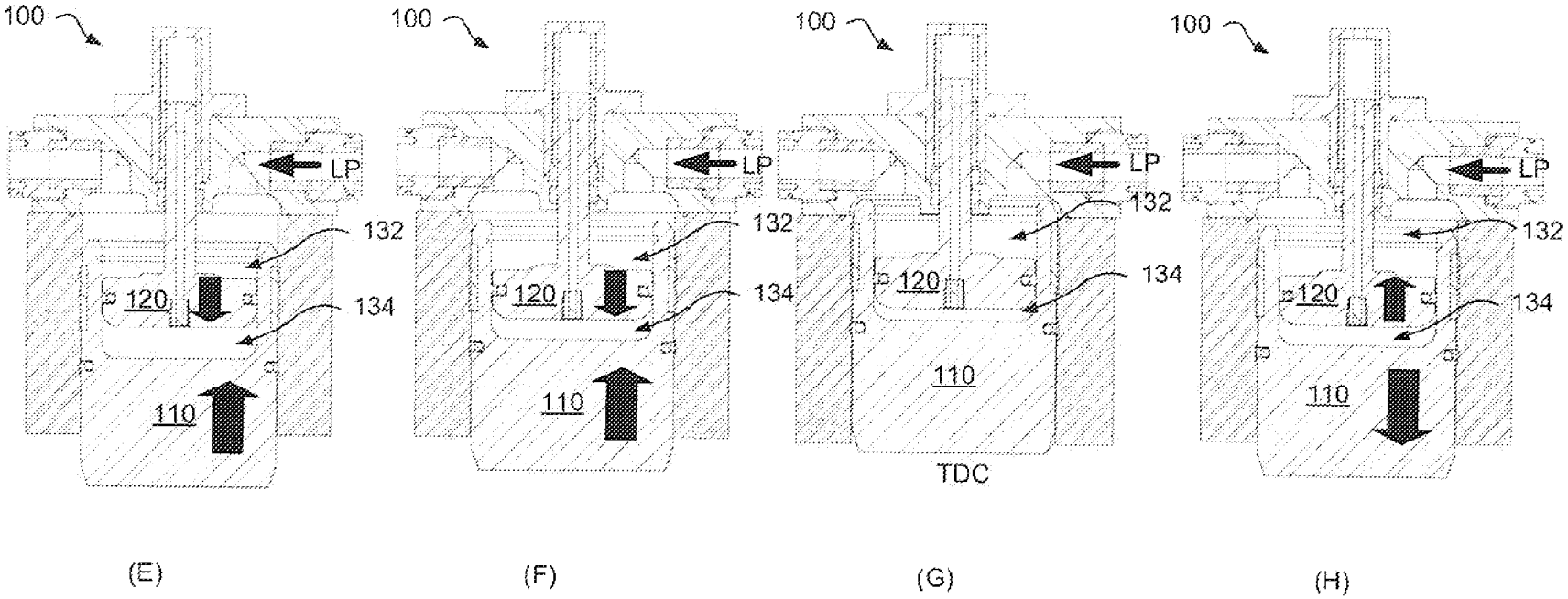
Figure 6:
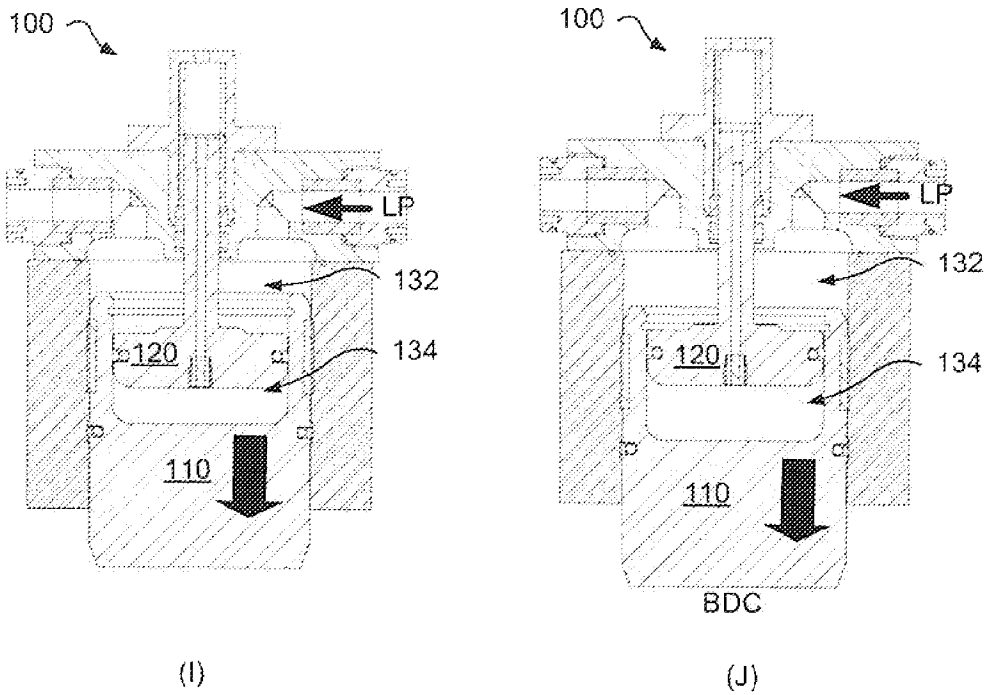
Figure 7:
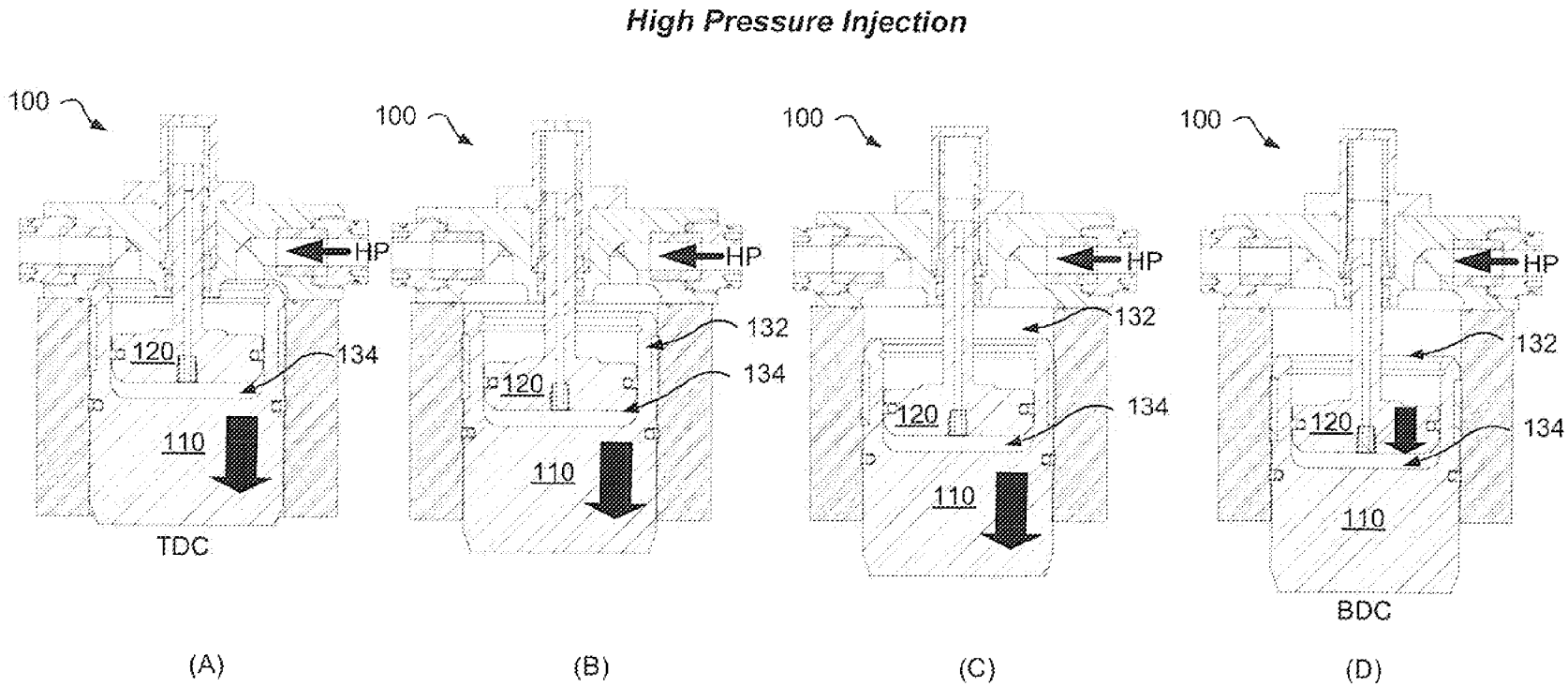
FIG. 7A to 7G are schematics showing the operation of the piston unit in a high pressure injection mode of operation.
Figure 7:
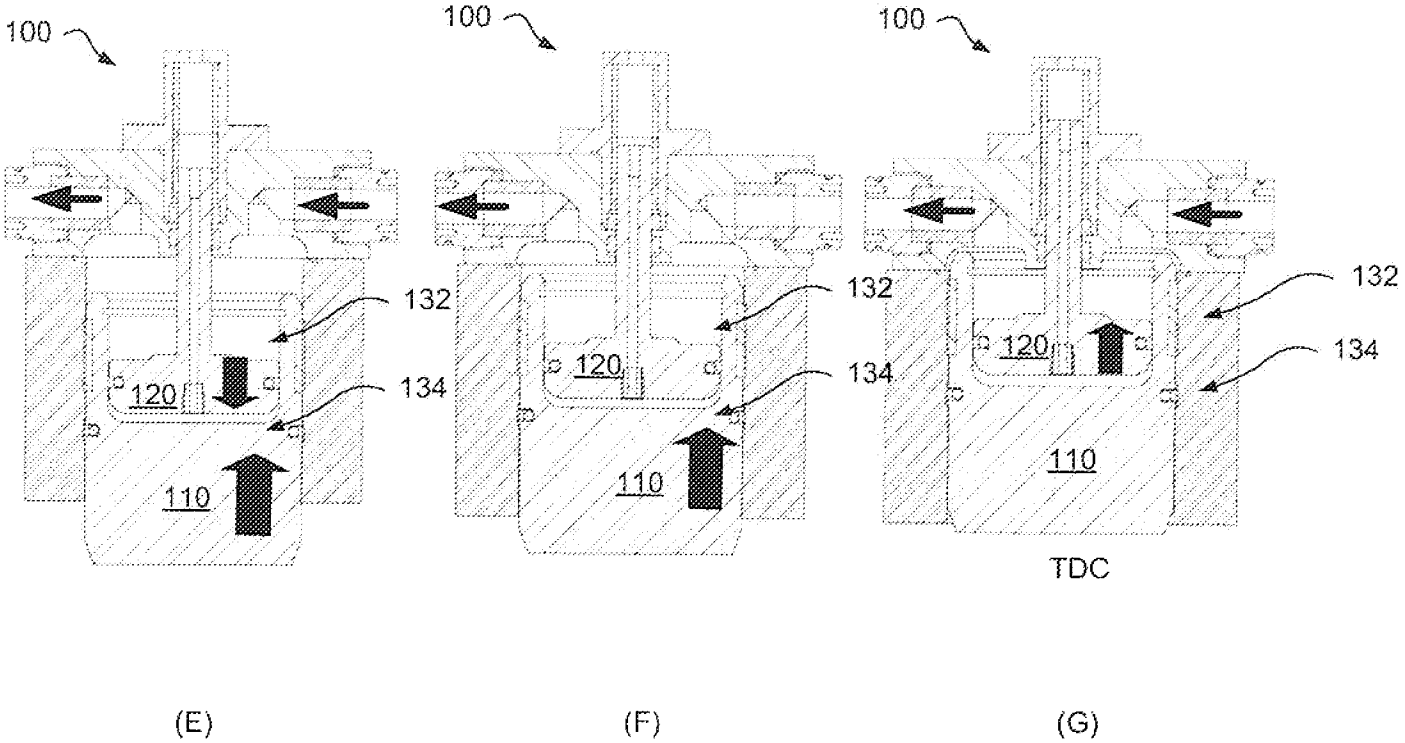
Figure 8:
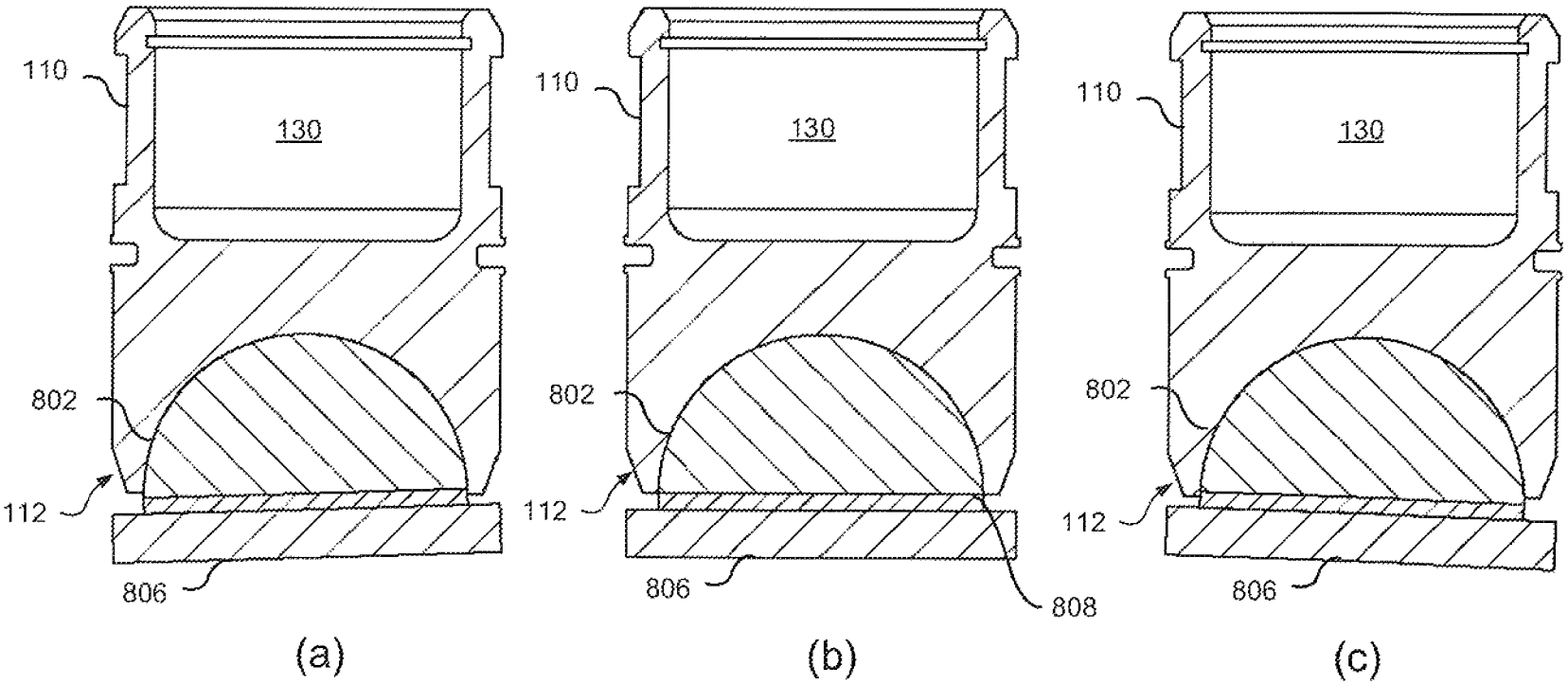
FIGS. 8A to 8C show an alternative embodiment of the primary piston of the piston unit.

Although two modes of operation are described, the piston unit is capable of variable modes of operation based upon the injection pressure applied at the fluid inlet 160. FIGS. 6 and 7 are provided as illustrative examples, however, one of skill in the art would understand that the operation of the piston unit 100 can be transitioned by varying degrees between low and high pressure injection to increase or decrease the compression of the gas cavity 134 to provide variable control of the primary piston 110.

FIGS. 8A to 8C show an alternative primary piston 110 configuration that can be utilized in an assembly to compensate for any possible deformation (e.g. deflection from true) in the block 150, cylinder bore 152 and/or assembly thereof, which can be caused during operation of the piston unit 100 that arises during heavy breaking loads experienced by the piston unit 100 (block 150 and bore 152). Compensation for this possible deformation can allow for misalignment between the bottom 112 and the cam surface, while inhibiting undesired wear in their surfaces due to any misalignment. In this manner, appropriate contact between the cam and the primary piston 110 is effectively maintained during any deformation, as further described below.

The primary piston 110 is provided with a ball joint 802 mounted within the piston bottom 112 and provides a plate 806 within the lower side of the primary piston 110. The ball joint 802 can be retained within the piston head, for example by a snap ring 808. As shown in FIGS. 8A and 8C the ball joint 802 allows for pivotal movement of the plate 806 to move relative to the primary piston 110. The movement of the ball joint 802 allows the bottom of the plate 806 to remain true to the cam face to help avoid any potential scraping of the cam surface, as a result of using the ball joint 802 that allows the piston free movement. Therefore, the piston bottom 112 is maintained in appropriate contact with the outer surface of the cam during any deformation, thus helping to reduce rotational/lateral loads/wear and compensate for misalignment or miss-match between the cam and the bottom 112 of the primary piston 110.

In view of the above, described is the piston unit 100 having the primary piston 110 with a secondary piston bore 130 in a portion thereof, such that the primary piston 110 is operable to reciprocate within a primary piston bore 152 along the axis A. The secondary piston 120 is configured to be received within the secondary piston bore 130, and operable to reciprocate therein along the axis A of the primary piston bore 152. Positioning of the secondary piston 120 within the secondary piston bore 130 defines a gas cavity 132 between a bottom surface of the secondary piston 120 and the opposing and adjacent surfaces of the secondary piston bore 130. The primary piston 110 and the secondary piston 120 are operable to reciprocate along the axis A, relative to each other, such that the primary piston 110 is movable within the primary piston bore 152 and the secondary piston 120 able to move within the secondary piston bore 130 contrary to the movement of the primary piston 110. Further, the piston unit 100 has the head 140 for encasing the primary piston 110 and the secondary piston 120 within the main block 150, thereby providing the fluid cavity 132 positioned between the top surface of the secondary piston 120 and the head 140. As discussed above, changes in volume of the gas cavity 134 can affect changes in the volume of the fluid cavity 132, as the gas cavity 134 is located on one side of the secondary piston 120 and the fluid cavity 132 is located on the opposing side of the secondary piston 120. As discussed, relative positioning of the secondary piston 120 between the cavities 132,134 can be influenced by differences (i.e. a differential) in the fluid cavity pressure $P_{cav}$ and the gas cavity pressure $P_{gas}$.

Figure 9:
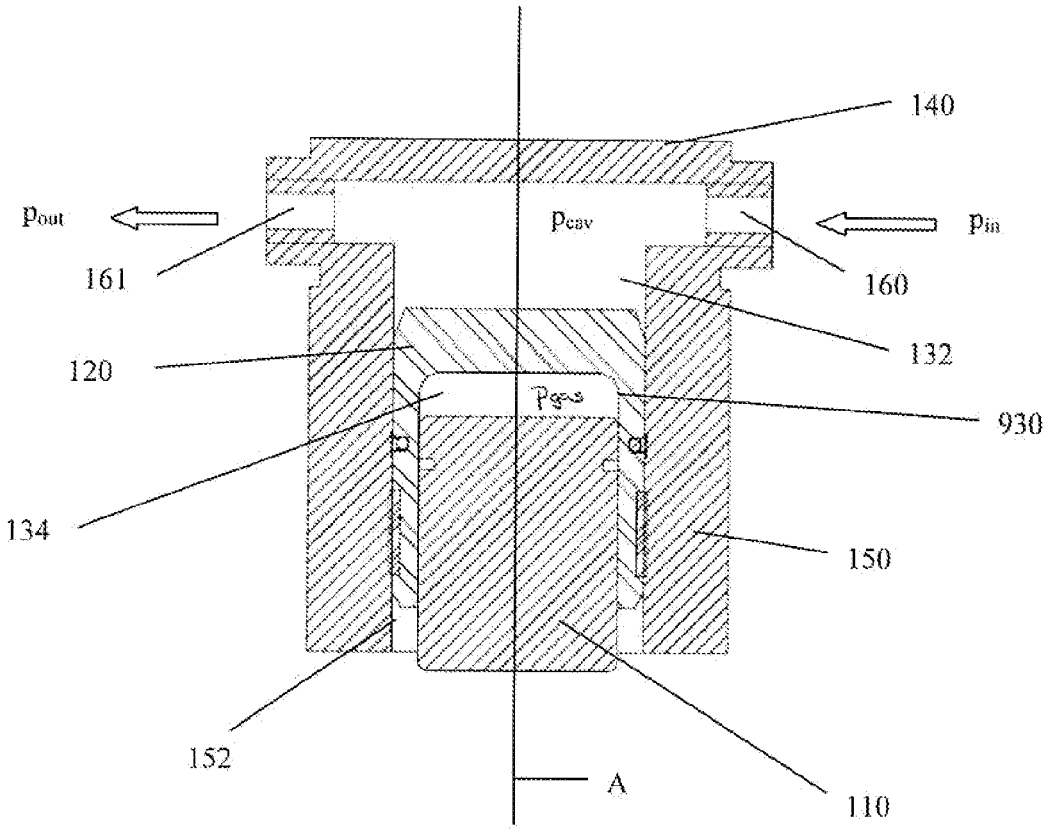
FIG. 9 shows an alternative embodiment of the piston unit described herein.

In an alternative embodiment of the piston unit, shown in FIG. 9, the primary piston 110 is positioned inside a primary piston bore 930 located in the secondary piston 120. In this embodiment, the secondary piston 120 is received within the cylinder bore 152 of the main block 150. The cylinder bore 152 and the secondary piston 120 are configured and sized to allow for reciprocal movement of the secondary piston 120, along axis A, within the cylinder bore 152. The primary piston 110 is configured and sized to allow for reciprocal movement within the primary piston bore 930 and is able to move within the piston bore 930 contrary to the movement of the secondary piston 120. A fluid cavity 132 is defined by opposed and adjacent surfaces between the cylinder bore 152, the pistons 110,120 and the cylinder head 140. A gas cavity 134 is located between the upper surface of the primary piston bore 930 and the opposed top surface of the primary piston 110. While not shown, it will be understood that a means for feeding gas to the gas cavity 134 is also included which may be, for example, through a stem located on the secondary piston 120, as described in the above embodiments. Other ways of feeding gas to the gas cavity 134 may also be used, as described herein. It will be understood that the operation of this embodiment of the piston unit is as described above The movement of the two pistons relative to each other is as described herein.

In one embodiment a piston unit is provided that includes a main block having a main bore located there-through and having an axis extending lengthwise through the main bore. The piston unit further includes a piston sub-assembly configured to be received within the main bore and operable to reciprocate therein along the axis of the main bore. The piston sub-assembly includes a first piston comprising a piston bore in a portion thereof and a second piston operable to reciprocate within the piston bore along the axis of the main bore. The first piston and second piston define a gas cavity therebetween and are operable to reciprocate along the axis relative to each other such that the first piston is movable within the piston bore contrary to the movement of the second piston. The piston unit further includes a head for encasing the piston sub-assembly within the main block, thereby providing a fluid cavity positioned between a top surface of the sub-assembly and the head. It will be understood that the piston sub-assembly and the first and second pistons are not necessarily concentric with the axis of the main bore.

It is also recognised in a further embodiment, the secondary bore 130 can be positioned on an axis (not shown) that is at an angle to the axis A. For example, the secondary bore 130 can be positioned in the primary piston 110 at the angle that is orthogonal to the axis A of the cylinder bore 152. It is recognised in this alternative embodiment that passive piston 120 remains positioned between the fluid cavity 132 and gas cavity 134 and is operable to move (e.g. reciprocate) within the secondary bore 130, since one side of the secondary piston 120 is in communication with the fluid cavity 132 and the opposite side is in communication with the gas cavity 134.

It will be apparent to one skilled in the art that numerous modifications and departures from the specific embodiments described herein can be made without departing from the spirit and scope of the present disclosure.

The invention claimed is:

1. A piston unit comprising:

a main block having a primary piston bore located there-through and having an axis extending lengthwise through the primary piston bore;

a primary piston comprising a secondary piston bore in a portion thereof, the primary piston operable to reciprocate within the primary piston bore along the axis;

a secondary piston configured to be received within the secondary piston bore, and operable to reciprocate therein along the axis of the channel, the secondary piston defining a gas cavity between a bottom surface of the secondary piston and the opposing and adjacent surfaces of the secondary piston bore;

the primary piston and the secondary piston operable to reciprocate along the axis relative to each other such that the primary piston is movable within the primary piston bore and the secondary piston is moveable within the secondary piston bore contrary to the movement of the primary piston; and a head for encasing the primary piston and the secondary piston within the main block, thereby providing a fluid cavity positioned between a top surface of the secondary piston and the head.

2. The piston unit of claim 1, wherein the head further comprising a fluid inlet and a fluid outlet for allowing fluid to enter and exit the fluid cavity.

3. The piston unit of claim 2, wherein the fluid inlet and fluid outlet each comprise a one way valve.

4. The piston unit of claim 1, wherein the secondary piston bore surrounds the secondary piston defining a piston-in-piston configuration.

5. The piston unit of claim 1, wherein the secondary piston moves within the secondary piston bore relative to pressure of fluid injected into the fluid cavity.

6. The piston unit of claim 1, wherein the secondary piston further comprises a gas passageway extending there-through.

7. The piston unit of claim 6, wherein the secondary piston further comprises a stem extending there-from in communication with the gas passageway.

8. The piston unit of claim 7, wherein the head further comprises a gas inlet guide operable to fluidly couple to the secondary piston stem.

9. The piston unit of claim 6 wherein the gas passageway comprises a gas check valve.

10. The piston unit of claim 6, wherein the gas passageway is in direct fluid communication with the gas cavity.

11. The piston unit of claim 1, wherein the primary piston further comprises a recessed piston seal around the outer circumference thereof to contain fluid in the fluid cavity.

12. The piston unit of claim 1, wherein the secondary piston is retained within the secondary piston bore using a snap ring recessed on an interior surface of the secondary piston bore.

13. The piston unit of claim 1, wherein the secondary piston further comprises a recessed piston seal around an outer circumference thereof to contain fluid in the fluid cavity and gas in the gas cavity.

14. The piston unit of claim 1, wherein the movement of the primary piston is relative to the movement of an external surface interfacing with a lower surface of the primary piston.

15. The piston unit of claim 1, wherein the movement of the primary piston is relative to the movement of an axle, the piston moving in relation to a mechanical actuator coupled to the axle.

16. The piston unit of claim 1, wherein the primary piston further comprises a piston bottom on a bottom surface thereof.

17. The piston unit of claim 16, wherein the piston bottom comprises a ball joint recessed within the bottom portion of the piston bottom, the ball joint coupled to a plate providing a pivotable contact surface with respect to the primary piston.

18. The piston unit of claim 1, wherein at least one of the primary piston and the secondary piston are non-concentric about the axis.

19. A piston unit comprising:

a main block having a secondary piston bore located there-through and having an axis extending lengthwise through the secondary piston bore;

a secondary piston comprising a primary piston bore in a portion thereof, the secondary piston operable to reciprocate within the secondary piston bore along the axis;

a primary piston configured to be received within the primary piston bore, and operable to reciprocate therein along the axis of the channel, the primary piston defining a gas cavity between a top surface of the primary piston and the opposing and adjacent surfaces of the primary piston bore;

the primary piston and the secondary piston operable to reciprocate along the axis relative to each other such that the primary piston is movable within the primary piston bore and the secondary piston is moveable within the secondary piston bore contrary to the movement of the primary piston; and a head for encasing the primary piston and the secondary piston within the main block, thereby providing a fluid cavity positioned between a top surface of the secondary piston and the head.

20. A piston unit comprising:

a main block having a main bore located there-through and having an axis extending lengthwise through the main bore;

a piston sub-assembly configured to be received within the main bore and operable to reciprocate therein along the axis of the main bore, the piston sub-assembly comprising a first piston comprising a piston bore in a portion thereof, and a second piston operable to reciprocate within the piston bore along the axis of the main bore, the first piston and second piston defining a gas cavity therebetween and being operable to reciprocate along the axis relative to each other such that the first piston is movable within the piston bore contrary to the movement of the second piston; and a head for encasing the piston sub-assembly within the main block, thereby providing a fluid cavity positioned between a top surface of the sub-assembly and the head.

* * * * *